US007610648B2

(12) United States Patent
Bongiovanni

(10) Patent No.: US 7,610,648 B2
(45) Date of Patent: Nov. 3, 2009

(54) STAINLESS STEEL TOOL AND METHOD OF FORMING

(75) Inventor: Carl A. Bongiovanni, Gibsonia, PA (US)

(73) Assignee: Bon Tool Company, Gibsonia, PA (US)

( * ) Notice: Subject to any disclaimer, the term of this patent is extended or adjusted under 35 U.S.C. 154(b) by 750 days.

(21) Appl. No.: 11/033,952

(22) Filed: Jan. 12, 2005

(65) Prior Publication Data

US 2006/0150358 A1 Jul. 13, 2006

(51) Int. Cl.
*B05C 17/10* (2006.01)

(52) U.S. Cl. ..... 15/235.4; 15/235.8; 404/118

(58) Field of Classification Search ..... 15/235.4, 15/235.8, 235.3, 145, 245.1; 425/458; 404/118
See application file for complete search history.

(56) References Cited

U.S. PATENT DOCUMENTS

| | | | | |
|---|---|---|---|---|
| 1,683,373 | A | 9/1928 | Ross et al. | |
| 2,883,854 | A | 4/1959 | Marmon | |
| 3,109,189 | A | 11/1963 | Eldridge | |
| 3,155,997 | A | 11/1964 | Gallagher | |
| 3,608,944 | A | 9/1971 | Turner | |
| 4,432,115 | A | 2/1984 | Fehler | |
| 4,737,097 | A | 4/1988 | Cotugno | |
| 4,879,780 | A | 11/1989 | Prebeck | |
| 5,160,748 | A | 11/1992 | Gauuan | |
| 5,368,461 | A | 11/1994 | Murphy | |
| 5,397,652 | A * | 3/1995 | Carey et al. | 428/610 |
| 6,032,320 | A * | 3/2000 | McComber et al. | 15/235.4 |
| 6,077,171 | A * | 6/2000 | Yoneyama | 473/291 |
| 6,138,318 | A * | 10/2000 | Pyatt et al. | 15/235.4 |
| 6,374,859 | B1 * | 4/2002 | Vu et al. | 137/884 |
| 6,627,049 | B2 * | 9/2003 | Jonsson et al. | 204/192.16 |
| 7,213,295 | B2 * | 5/2007 | Chang | 15/235.4 |
| 2006/0150358 | A1 * | 7/2006 | Bongiovanni | 15/235.4 |
| 2007/0180641 | A1 * | 8/2007 | Bongiovanni | 15/235.4 |

FOREIGN PATENT DOCUMENTS

GB 2393475 A 3/2004

OTHER PUBLICATIONS

Cleform Tool Co., 2003, Catalog No. 31, pp. 29-31 and 34-35.
Farrell Equipment and Supply Company, 2004 Catalog, pp. 87 and 92.

* cited by examiner

*Primary Examiner*—Lee D Wilson

(57) ABSTRACT

Concrete-finishing tools and attachments, such as edgers, groovers, and groover attachments, are disclosed. The tools and attachments may include a unitary stainless steel body or element. The tools and attachments may be formed by a method or methods including casting and forging.

2 Claims, 17 Drawing Sheets

STAINLESS STEEL TOOL AND METHOD OF FORMING

BACKGROUND OF THE INVENTION

After concrete has been placed and spread, concrete-finishing tools are employed to shape the concrete before it hardens. These tools include groovers and edgers, which have projecting elements that indent and smooth or otherwise shape slabs of concrete during operation.

SUMMARY OF THE INVENTION

The present invention is directed to concrete-finishing tools, such as groovers and edgers, and concrete-shaping element attachments that affix to concrete-finishing tools such as trowels and floats. In one embodiment, a concrete-finishing tool includes a unitary stainless steel ("stainless steel" refers herein to various known or future developed stainless steel alloys) body that includes a top face and a bottom face. A handle support may project from the top face, and a concrete-shaping element, such as a grooving bit or an edging lip, may project from the bottom face. The body's unitary and stainless steel forms advantageously provide high strength, hardness, and durability, and a high corrosion resistance which will remain high even after surface wear and damage.

The body may be manufactured by a method that provides further advantageous properties. One method may be casting, which provides good dimensional repeatability among multiple manufactured bodies. The casting form may be die-casting, or more specifically, investment casting. Another method may be forging, which provides a unitary body with high directional strength, structural integrity, and toughness.

In another embodiment, a unitary stainless steel groover attachment includes a grooving bit and supports. The supports may be configured for affixing to a concrete-finishing tool, such as a trowel or float.

In another embodiment, a groover includes a unitary body that is stainless steel. The stainless steel may be in a form that is not sheet metal. The unitary body may include a grooving bit projecting from the body.

In another embodiment, an edger includes a unitary body that is stainless steel. The stainless steel may be in a form that is not sheet metal. The unitary body may include an edging lip projecting from the body.

In another embodiment, a method for manufacturing a concrete-finishing tool includes casting a unitary body of stainless steel that includes a top face and a bottom face. A handle support may project from the top face, and a concrete-shaping element may project from the bottom face.

In another embodiment, a concrete-finishing tool includes a unitary stainless steel body with a top face and a bottom face. The unitary stainless steel body may further include means for supporting a handle, wherein the means for supporting a handle projects from the top face. The unitary stainless steel body may further include means for shaping concrete, wherein the means for shaping concrete projects from the bottom face.

BRIEF DESCRIPTION OF THE DRAWINGS

The detailed description is better understood in conjunction with the accompanying drawings, in which like reference characters represent like elements, as follows.

DETAILED DESCRIPTION

Figure 1:
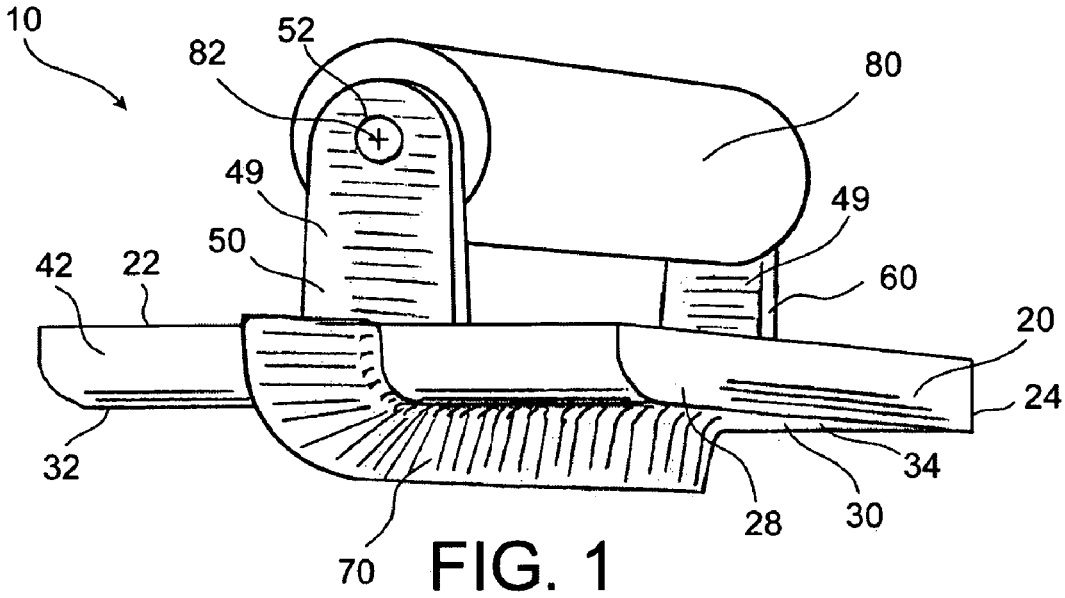
FIG. 1 is a perspective view of an embodiment of a groover.
Figure 2:
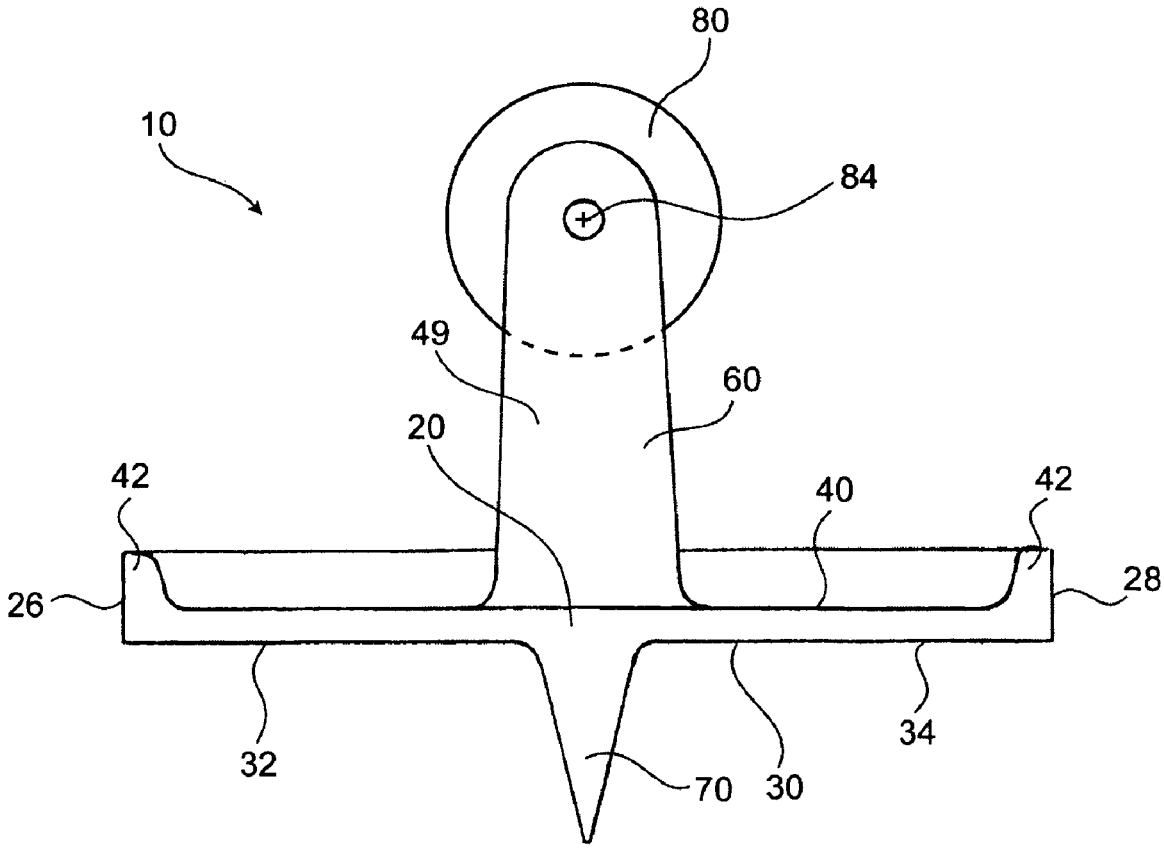
FIG. 2 is a rear view of the embodiment of FIG. 1.
Figure 3:
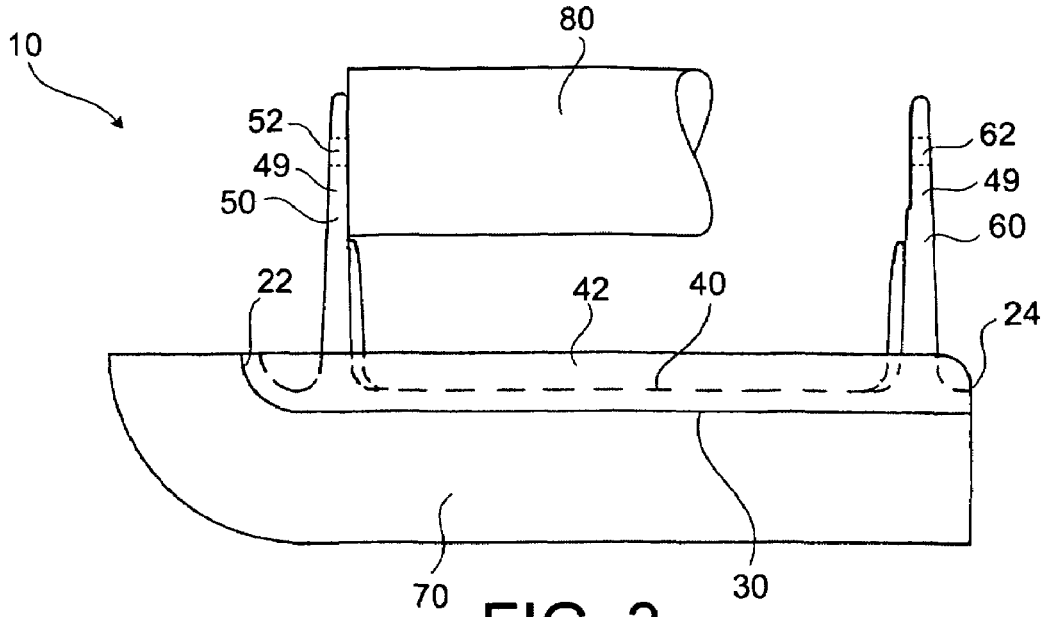
FIG. 3 is a side view of the embodiment of FIG. 1.
Figure 4:
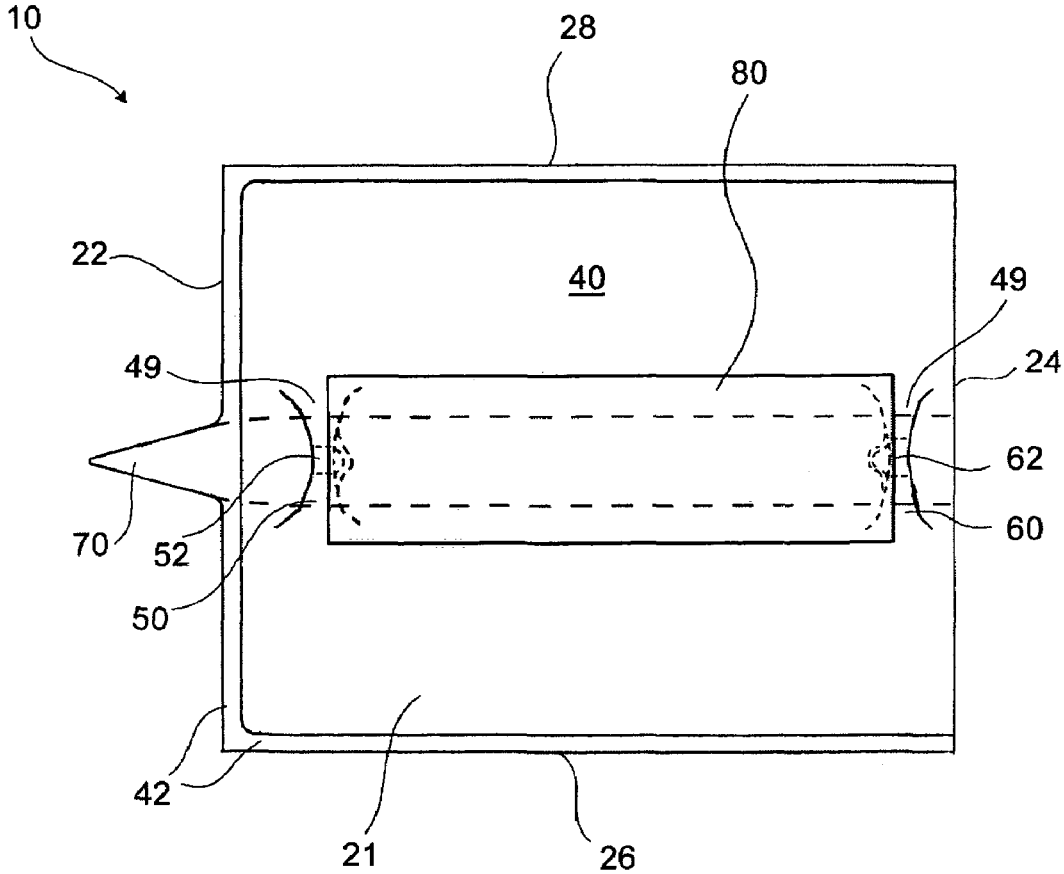
FIG. 4 is a top view of the embodiment of FIG. 1.

Because of the demands inherent in their operation, the main bodies of groovers and edgers are subject to deterioration.

Cast zinc alloys, malleable iron, and brass alloys, such as bronze, are forms used for the main bodies of groovers and edgers, as well as grooving or edging attachments that affix to other concrete tools such as trowels. By casting, a body or attachment can be formed of a single piece, providing greater rigidity and durability than multiple-piece constructions. But, because the strength, hardness, and corrosion resistance properties of zinc and brass alloys and malleable iron are mediocre, bodies and attachments made from these materials still lack durability over prolonged use. Additionally, the bodies and attachments are commonly sanded or ground to a finish, resulting in rough surfaces that cause friction when slid against concrete during operation.

One method of improving the durability of groover and edger bodies or attachments is to coat them with a corrosion-resistant material. For example, a body of a groover may be plated with chromium, which has good corrosion resistance. However, the coating will eventually wear off from use.

Alternatively, some groover and edger bodies are made from stainless steel sheet metal. Stainless steel generally has greater strength and hardness than zinc and brass alloys, and malleable iron. Its corrosion resistance is also greater due to its inherent, protective surface film of chromium-rich oxide, which obviates the need to apply a corrosion-resistant coating. Additionally, when its surface film is penetrated or worn away, stainless steel will spontaneously regenerate the film on the newly-exposed surfaces, and thus remain highly resistant to corrosion, even after prolonged use.

However, bodies made from stainless steel sheet metal lack the dimensional repeatability of bodies manufactured by other methods, such as casting. Bodies made from sheet metal also lack optimum durability in their construction, and have more flexibility. Each body generally includes multiple pieces of sheet metal (or other materials) to form its parts, such as its base, projecting handle support, and concrete-shaping element. Such a construction requires additional fastening as compared to cast bodies, decreasing the integrity of the tool. Additionally, stainless steel sheet metal tools are commonly spot welded during manufacture, creating an additional manufacturing step of smoothing the welds. Furthermore, stainless steel sheet metal bodies lack the weight of other material forms, and may be less comfortable to the user.

In one embodiment of a concrete-finishing tool as shown in FIGS. 1-4, a groover 10 includes a unitary stainless steel body 20 that includes a concrete-shaping element, here a bit 70 for grooving, and a handle support 49, here the brackets 50 and 60. The bit 70 may be formed on the bottom face 30 of the body 20. The brackets 50 and 60 may be formed on the top face 40 of the body 20.

The body 20 may include a front edge 22 and a back edge 24, a first side 26 and a second side 28, and a bottom face 30 and a top face 40. The bottom face 30 and top face 40 may be generally flat and parallel, or shaped differently if desired. The bottom face 30 may include guiding portions 32 and 34, for guiding the groover 10 along concrete during operation. The guiding portions 32 and 34 may be flat and coplanar, or configured differently. The top face 40 includes a handle support 49, here the combination of brackets 50 and 60. The top face 40 may include a projecting portion 42 that extends along the first side 26, the front edge 22, and the second side 28, to improve the sturdiness of the body 20.

Figure 5:
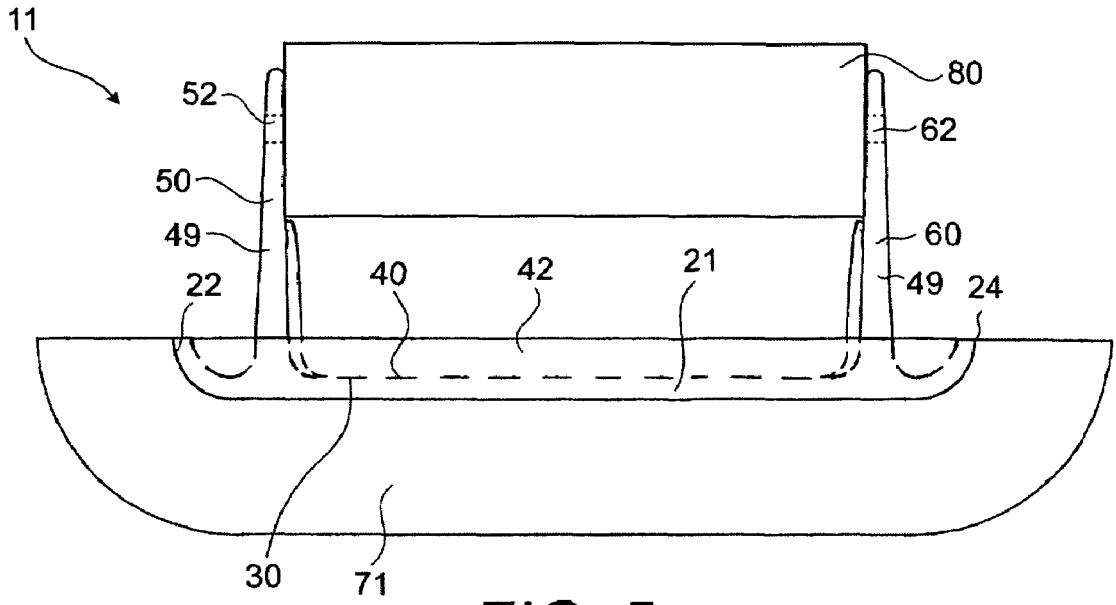
FIG. 5 is a side view of another embodiment of a groover, with an alternative grooving bit configuration.
Figure 6:
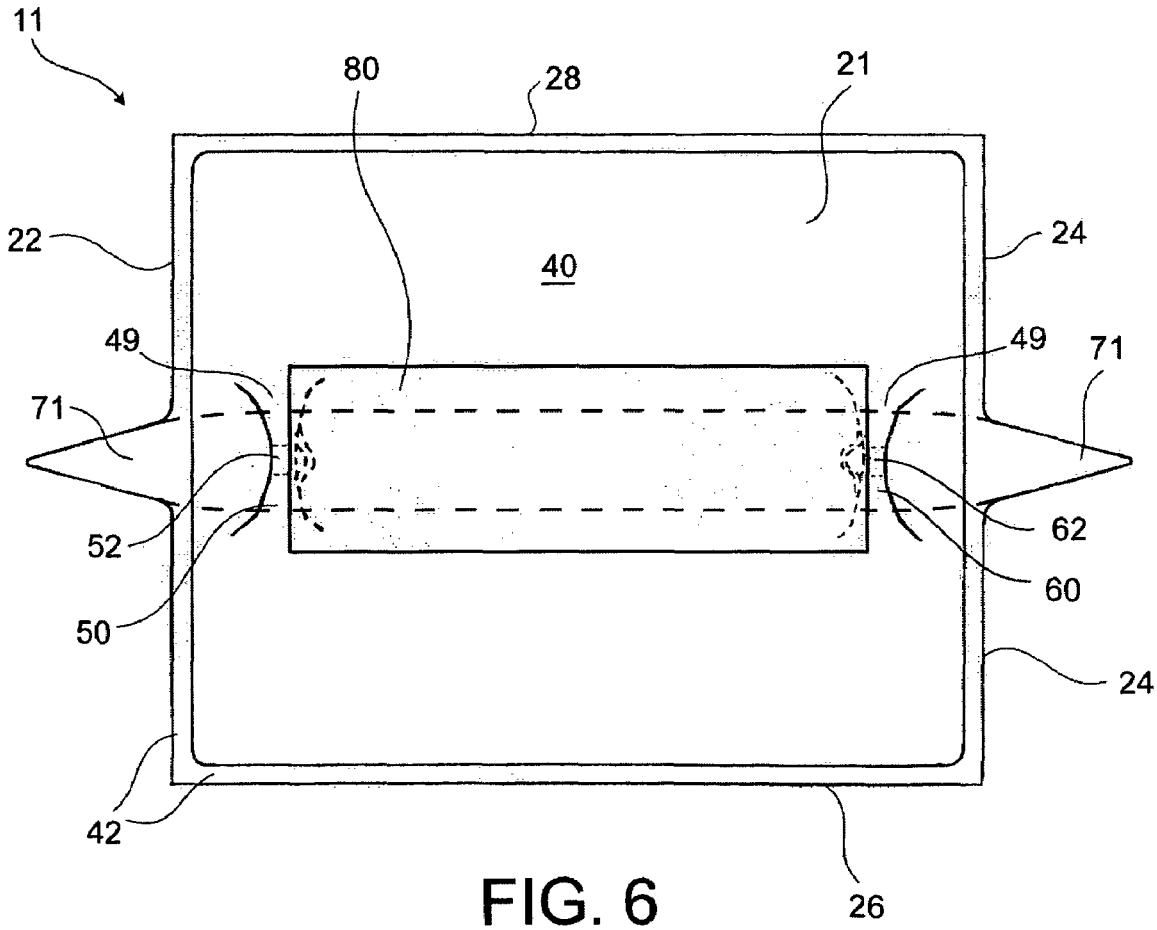
FIG. 6 is a top view of the embodiment in FIG. 5.

The bit 70 may be disposed between the guiding portions 32 and 34 of the bottom face 30, and may extend along the bottom face between the guiding portions 32 and 34. In the embodiment illustrated in FIG. 1-4, the bit 70 extends from near or at the back edge 24 to and past the front edge 22. In another embodiment as shown in FIGS. 5-6, the bit 71 of the body 21 of a groover 11 extends past both the front edge 22 and the back edge 24, and may be rounded at both ends, to facilitate bi-directional operation. In such a configuration, the bit 71 may extend past both the front and back edges 22 and 24 symmetrically or asymmetrically as desired.

The bit 70 in FIGS. 1-4 may project from the bottom face 30 at an angle substantially perpendicular to the plane defined by the guiding portions 32 and 34. However, the bit 70 may project at a different angle if desired. As viewed from the perspective of FIG. 2, the bit 70 may have a generally triangular cross-section, which may narrow in the portion extending past the front edge 22 (and the portion extending past the back edge 24, if applicable). The bit 70 may be alternatively shaped as desired.

The handle support 49, which in FIGS. 1-4 includes the combination of brackets 50 and 60, may project from the top face 40 of the body 20 as shown. The brackets 50 and 60 may include apertures 52 and 62 through which a handle 80 may be fastened by screws 82 and 84. Alternatively, apertures 52 and 62 and screws 82 and 84 may be replaced by another fastening means. The handle may be made of wood, plastic, rubber, or any material or materials desired.

Figure 7:
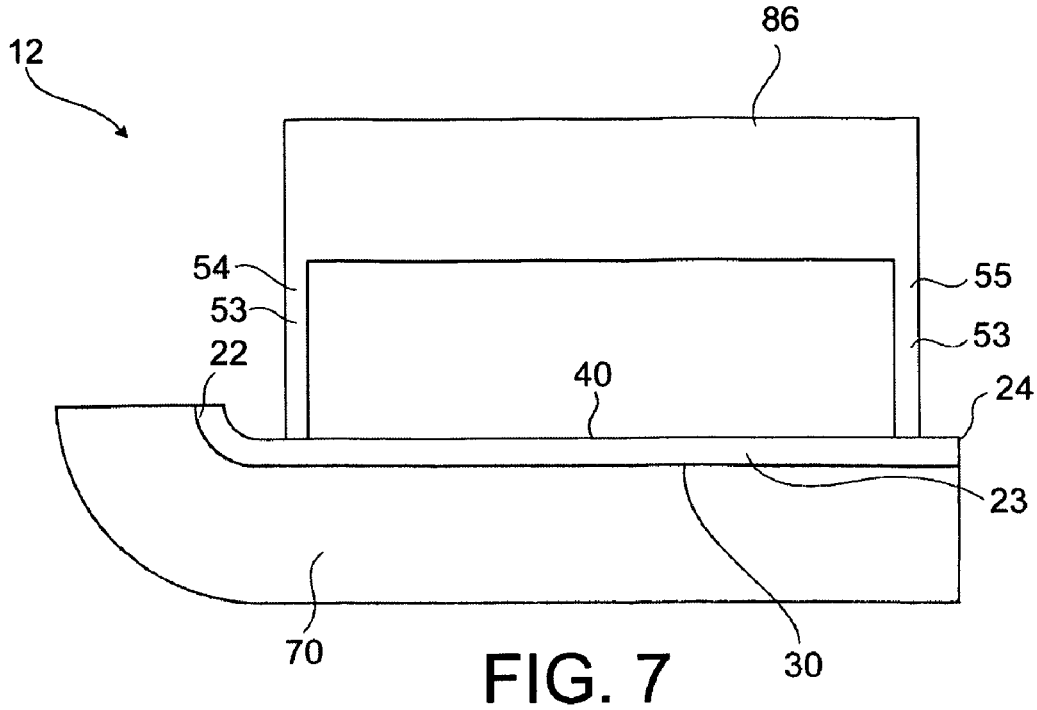
FIG. 7 is a side view of another embodiment of a groover, in which the handle is part of the unitary body.
Figure 8:
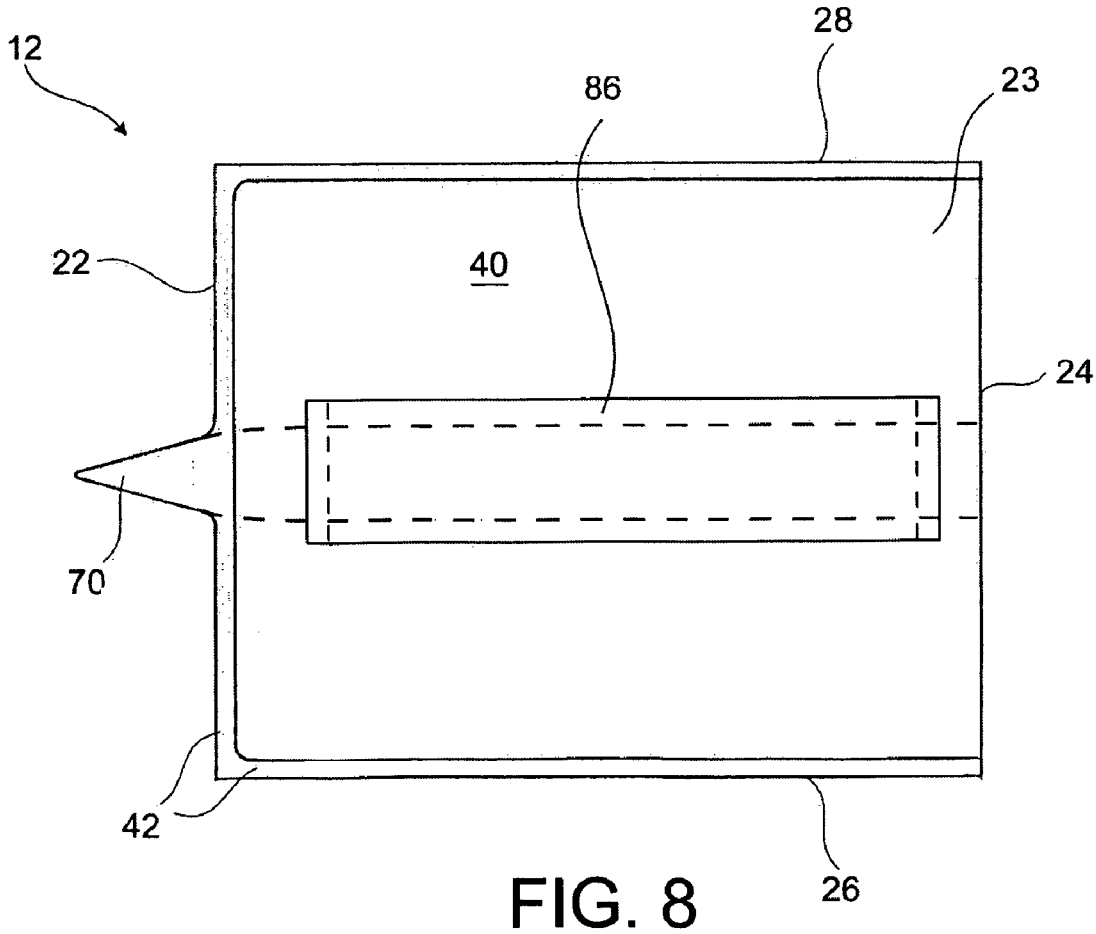
FIG. 8 is a top view of the embodiment of FIG. 7.

As an alternative to the brackets 50 and 60 and fastened handle 80, a groover 12 may include a handle 86 that is stainless steel and formed as part of the body 23, as shown in FIGS. 7-8. For example, the unitary body 23 may be cast as a single piece of stainless steel that includes a concrete-shaping element, such as the bit 70, projecting from the bottom face 30, and a handle support 53 comprising two brackets 54 and 55 and projecting from the top face 40, and an integral handle 86, the integral handle 86 extending between the brackets as shown.

Figure 9:
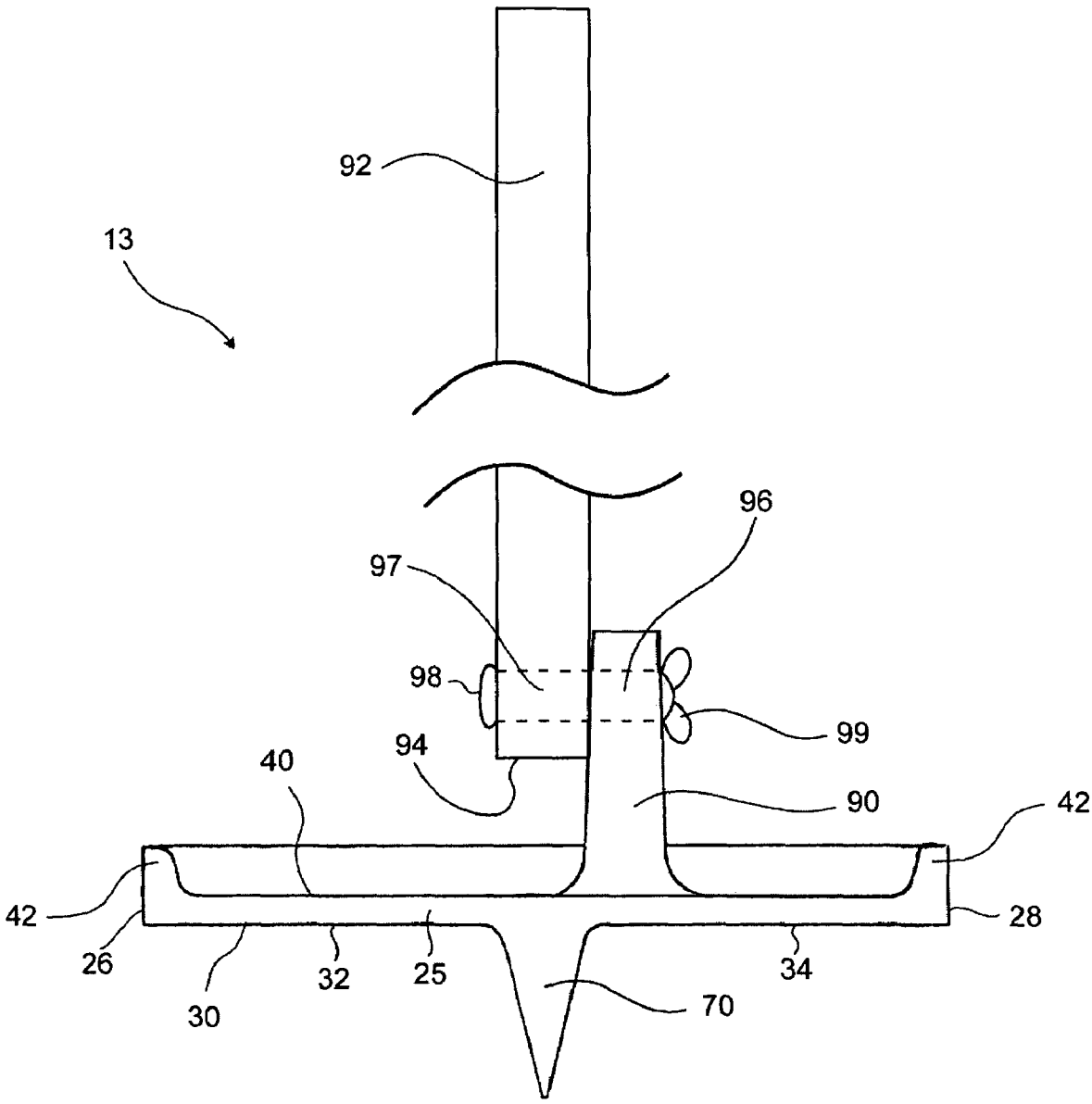
FIG. 9 is a rear view of another embodiment of a groover, with an alternative handle support and handle configuration.
Figure 10:
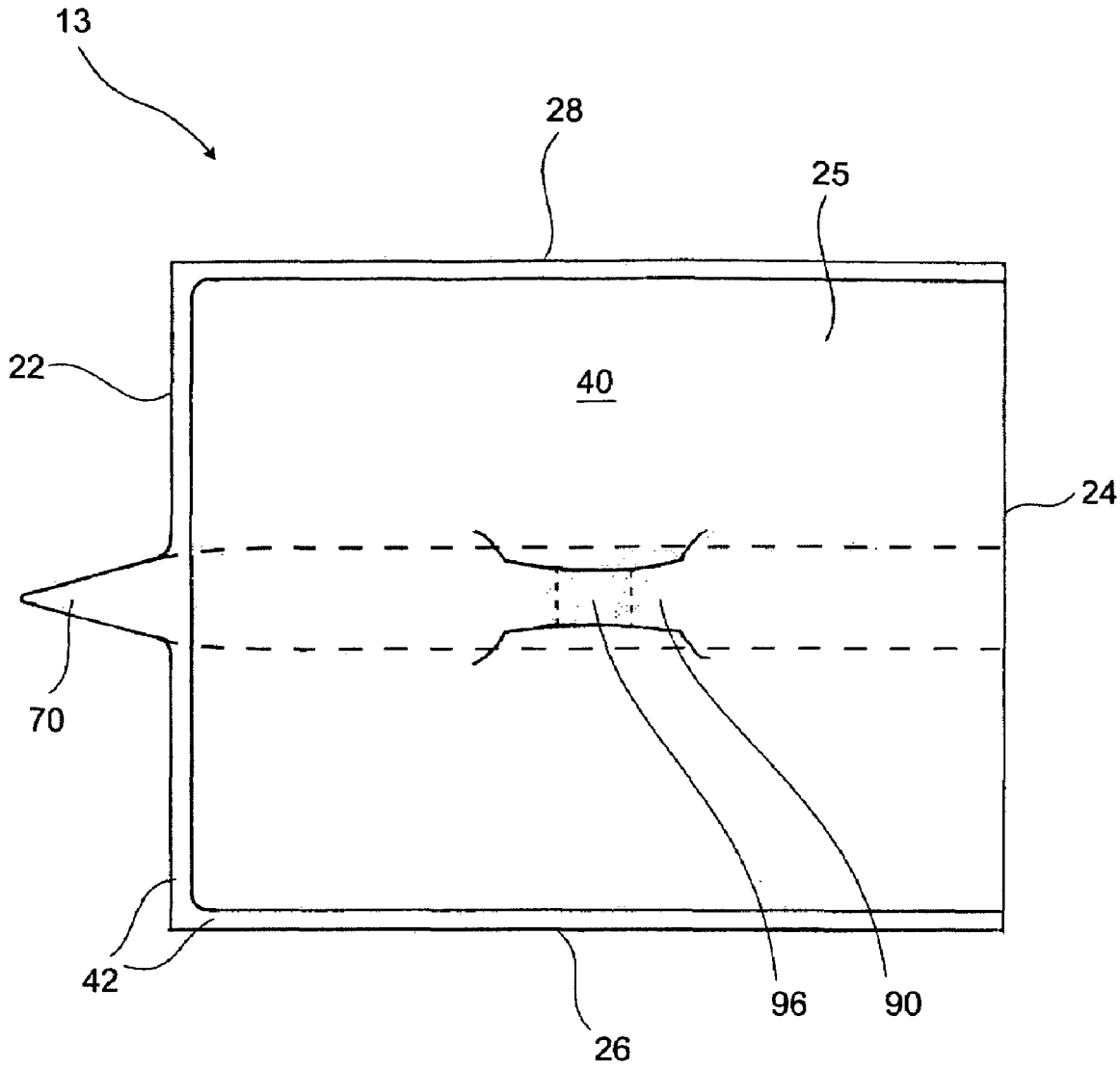
FIG. 10 is a top view of the embodiment of FIG. 9.
Figure 11:
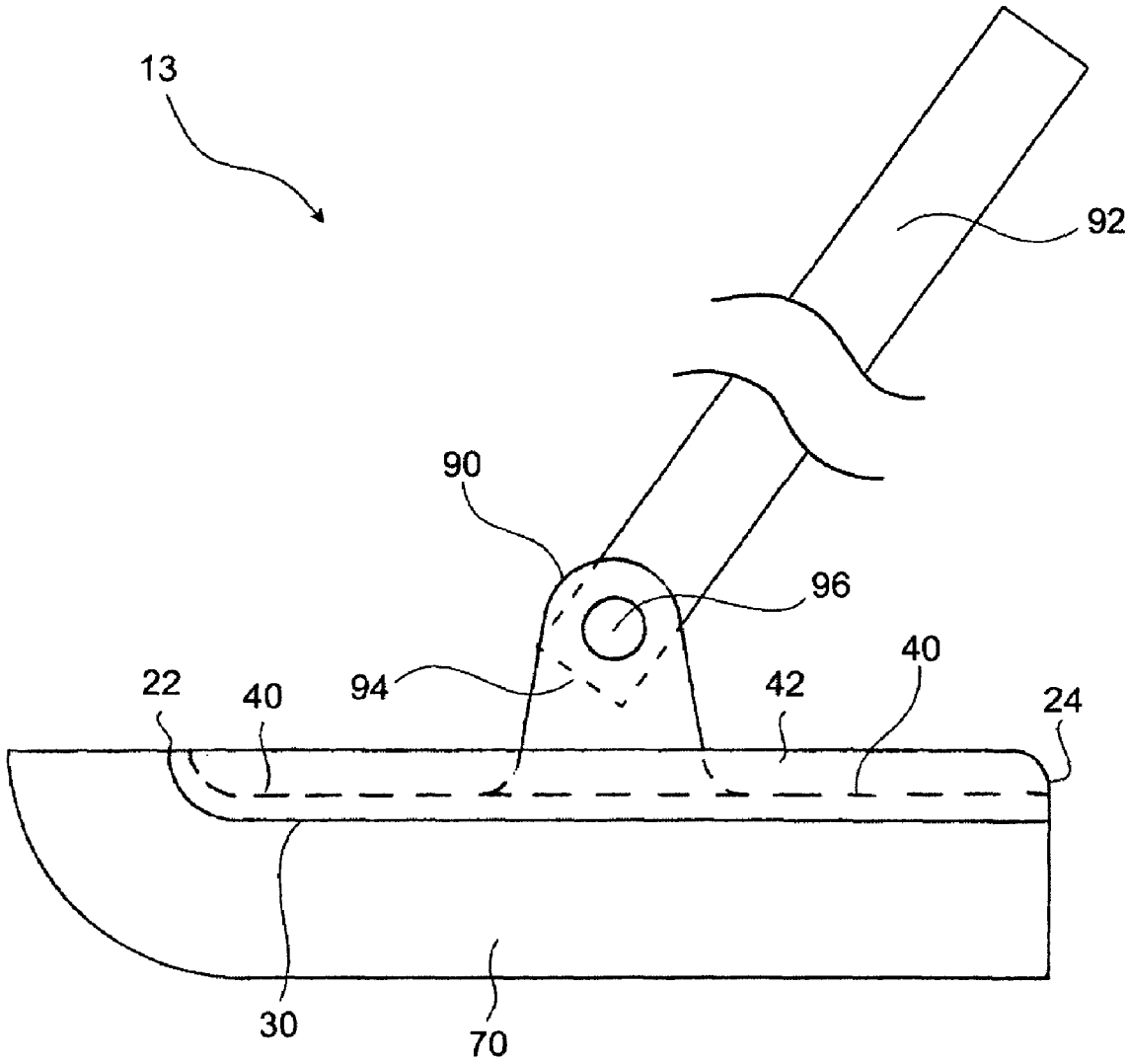
FIG. 11 is a side view of the embodiment of FIG. 9.

As another alternative to the brackets 50 and 60 and a fastened handle 80, FIGS. 9-11 show a groover 13 that includes a handle support, the bracket 90, projecting from the top face 40 of the body 25. The bracket 90 may be fastened to one end 94 of an alternative handle, the post 92. As may be seen with reference to FIG. 9, the post 92 may be fastened to the body 25 by aligning a bracket aperture 96 in the bracket 90 with a handle aperture 97 in the post 92 and placing a bolt 98 or other fastener therethrough. Where a bolt 98 is used to fasten the post 92 to the bracket 90, a locking wing nut 99 or other type of nut may be threaded onto the bolt 98 where the bolt 98 extends through the bracket aperture 96 and the handle aperture 97. Other fasteners may be used as desired to connect the post 92 to the bracket 90, fixedly, pivotally, or otherwise, including a post (not shown) having a head on one end and a hole near its other end through which a cotter pin may be placed.

FIG. 10 depicts a top view of the groover 13 of FIG. 9. As may be seen in FIG. 10, a bracket 90 may be formed on the top face of the body 25.

FIG. 11 illustrates a side view of the groover 13 depicted in FIGS. 9 and 10, wherein the post 92 is attached to the body by way of the bracket 90.

Alternatively, a groover in the embodiments above may include both the brackets 50 and 60 and the bracket 90.

Figure 12:
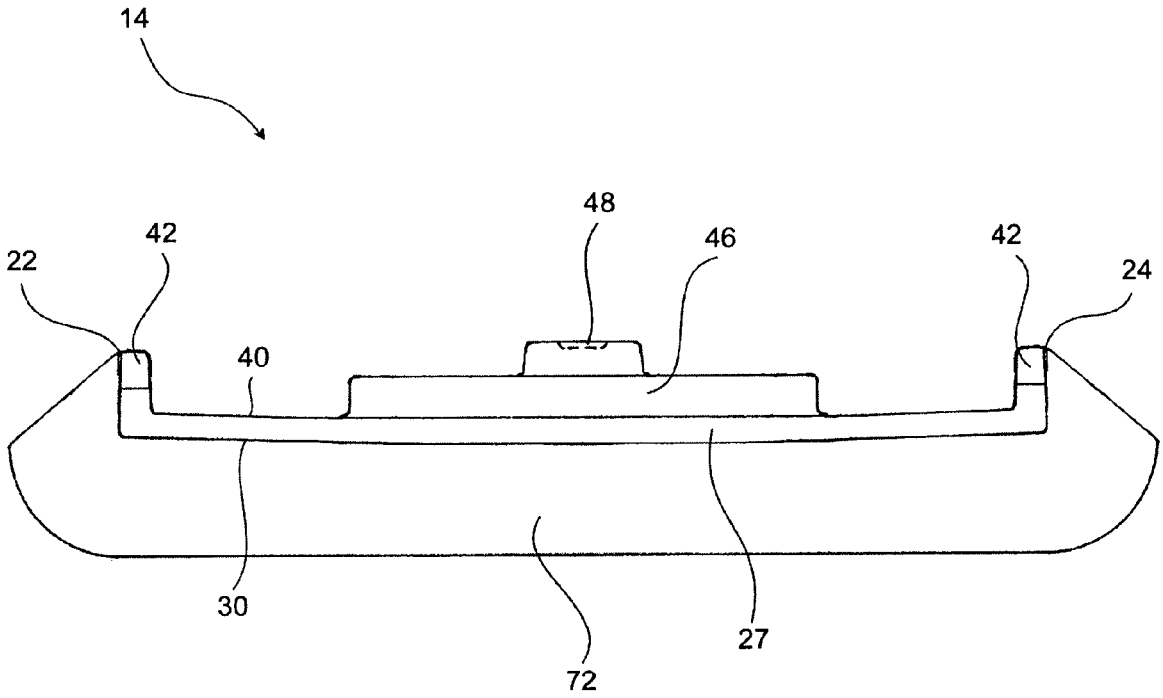
FIG. 12 is a side view of another embodiment of a groover.
Figure 13:
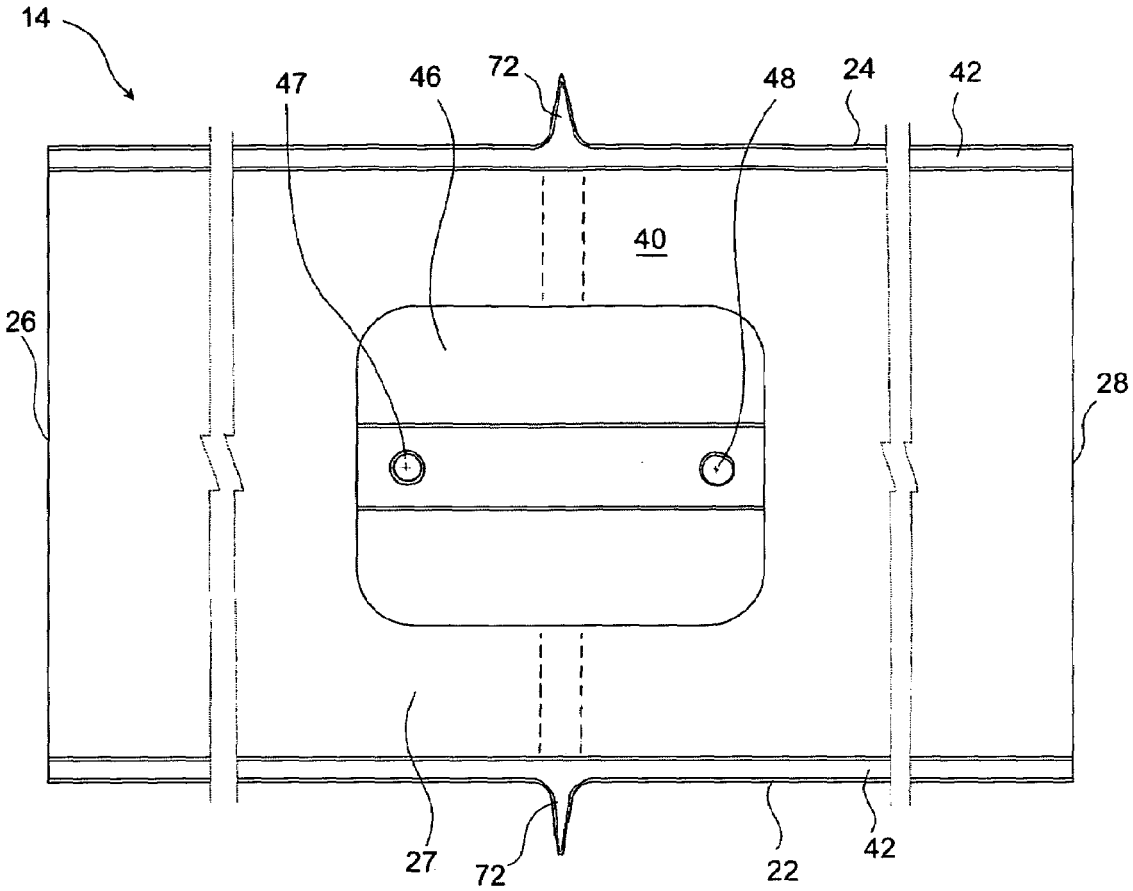
FIG. 13 is a top view of the embodiment of FIG. 12.
Figure 14:
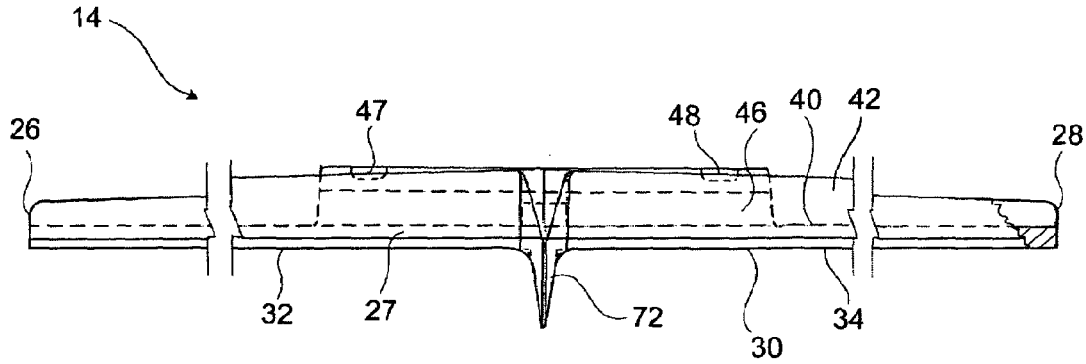
FIG. 14 is an end view of the embodiment of FIG. 12.

FIGS. 12-14 illustrates an embodiment of a groover 14, in which the body 27 has an alternative shape. The groover 14 in FIGS. 12-14 may be referred to as a "flying" groover. The body 27 of the flying groover 14 may be wider than the bodies of other embodiments, i.e., the body 27 may be greater distanced between its first side 26 and second side 28 than the groover 10 illustrated in FIGS. 1-4, for example. The embodiment of the flying groover 14 may also include an alternative handle support that is part of the unitary body 27. This handle support, the bracket support 46 in the embodiment illustrated, may project from the top face 40 and be adapted for fastening with a handle bracket portion (not shown). The handle bracket portion may fasten to a handle, such as the post 92 described above, or another handle. The bracket support 46 may include apertures 47 and 48 by which a handle bracket portion may be fastened by screws or bolts, or otherwise as known in the art. The bit 72 may also be shaped as desired, including as shown in FIGS. 12-14.

Figure 15:
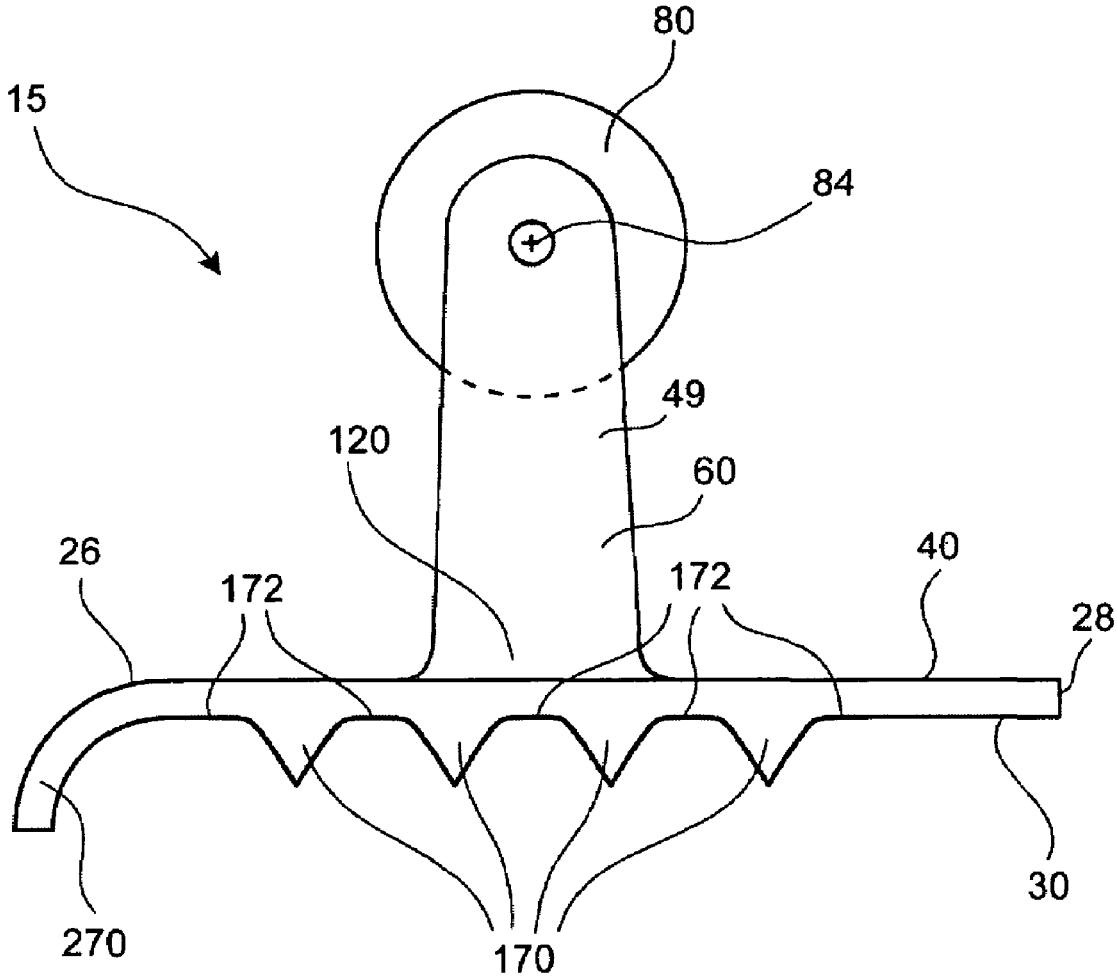
FIG. 15 is an end view of an embodiment of a groover with multiple grooving bits and an optional edging lip.
Figure 16:
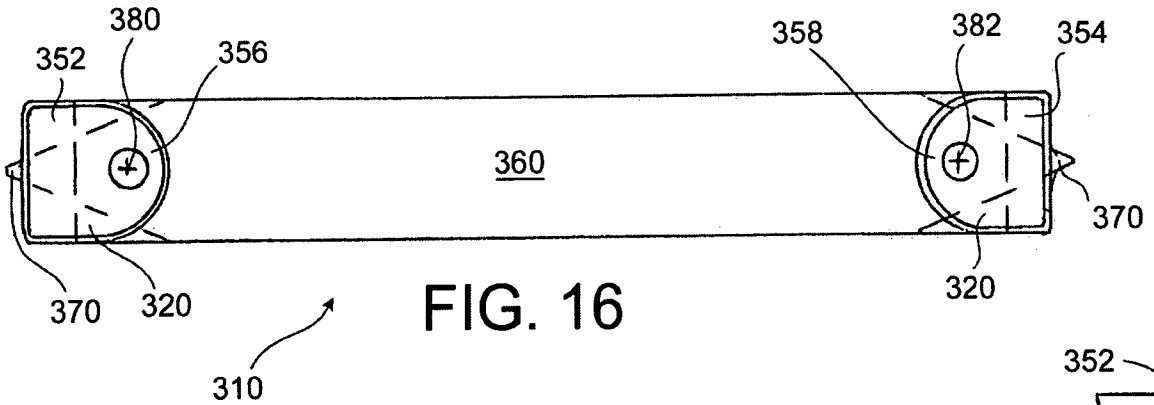
FIG. 16 is a top view of an embodiment of a grooving attachment.
Figure 19:
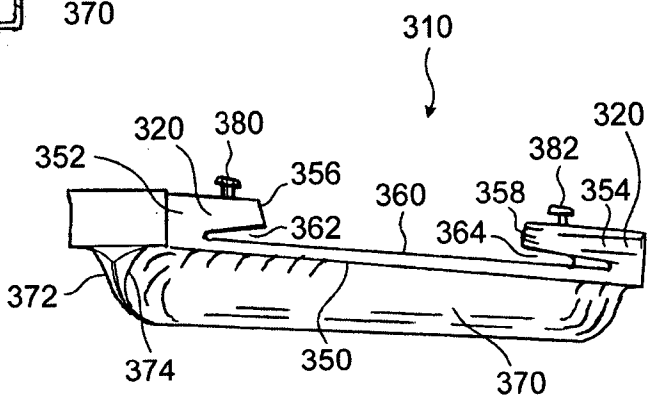
FIG. 19 is a perspective view of the embodiment of FIG. 16.
Figure 18:
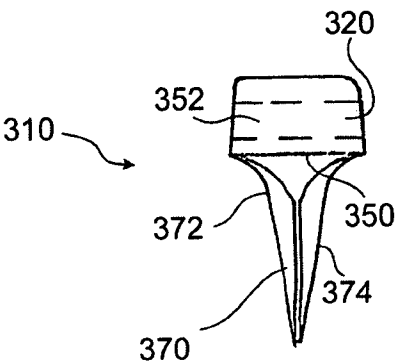
FIG. 18 is an end view of the embodiment of FIG. 16.
Figure 17:
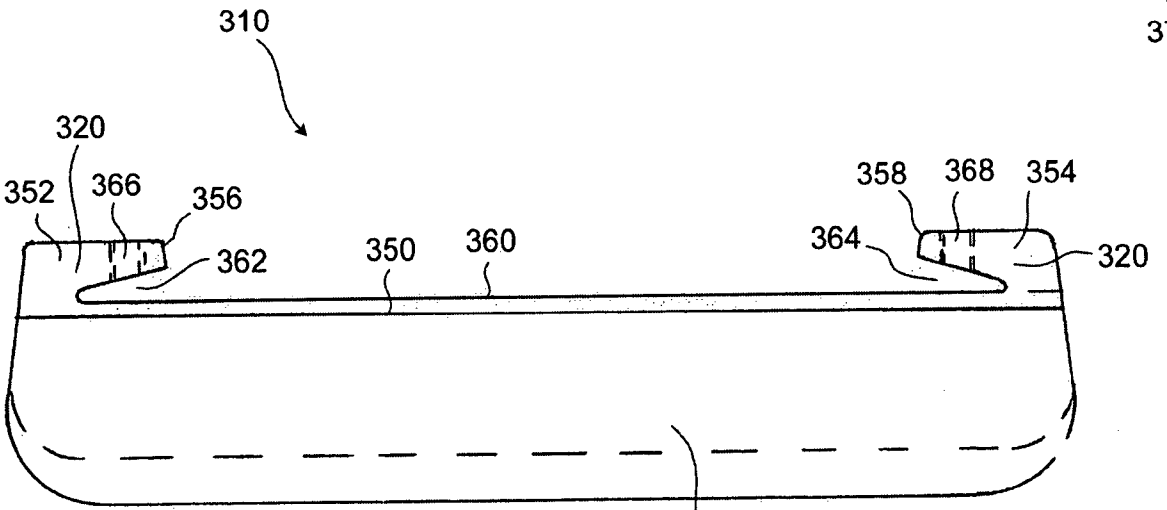
FIG. 17 is a side view of the embodiment of FIG. 16.

FIG. 15 shows another embodiment of a concrete-finishing tool. In this embodiment, the unitary stainless steel body 120 of the concrete-finishing tool 15 includes multiple concrete-shaping elements, including the bits 170 for grooving and a lip 270 for edging. Any number and combination of bits 170 and lips 270 may be included, as desired. The bits 170 may be disposed between the guiding portions 172 of the bottom face 30. The bits 170 may project from the bottom face 30 at an angle substantially perpendicular to the plane that may be defined by the guiding portions 172, or at another angle as desired. As viewed from the perspective of FIG. 15, the bits 170 may have a generally triangular cross-section. The bit 170 may not extend past the front and/or back edges of the body 120 (as the bit 70 extended in the embodiment of FIGS. 1-4). However, the bits 170 may extend past the front and/or back edge and narrow in portions such as described in the embodiments of FIGS. 1-6, if desired.

The body 120 in FIG. 15 may include a handle support 49 projecting from the top face 40. The handle support may include brackets 50 (not shown) and 60, as described in the embodiments above, through which a handle 80 may be fastened by screws 82 (not shown) and 84. Alternatively, the handle support may include a bracket 90 for fastening to an end 94 of a handle, such as the post 92, as described with respect to embodiments above, or another handle support and handle combination. Alternatively, the unitary body 120 may be formed as a single piece of stainless steel that includes the handle, such as described with respect to the brackets 54 and 55 and the handle 86 in FIGS. 7-8.

The lip 270 may be an edging element and may further be curved and project from the bottom face 30 and/or a side, such as the first side 26, at a desired angle or angles, such as shown in FIG. 15. The lip 270 may alternatively be shaped as a straight or flat element or otherwise as function dictates. Examples of other designs for edging elements are described with respect to the edgers discussed below.

In another embodiment shown in FIGS. 16-19, a unitary stainless steel concrete-shaping element attachment, a grooving attachment 310, is provided. The grooving attachment 310 may be affixed to a concrete-finishing tool (not shown). The grooving attachment 310 in this embodiment includes a bit 370 and an attachment mechanism 320 for affixing to a concrete-finishing tool, such as a fresno trowel. The bit 370 may have a triangular cross-section with concave surfaces 372 and 374 as viewed from the perspective of FIG. 18. But, as in the embodiments above, this shape may be altered as desired.

Formed on the top 350 of the bit 370 is the attachment mechanism 320, which may include attachment supports 352 and 354 with cantilevered portions 356 and 358. This configuration allows the grooving attachment 310 to be slid onto the body of a concrete-finishing tool such as a fresno trowel, such that the trowel may lie adjacent the surface 360, with the trowel body edges fitting within spaces 362 and 364. The grooving attachment 310 may then be affixed to the trowel through the apertures 366 and 368, such as by the screws 380 and 382. However, other fastening means may be substituted.

Figure 20:
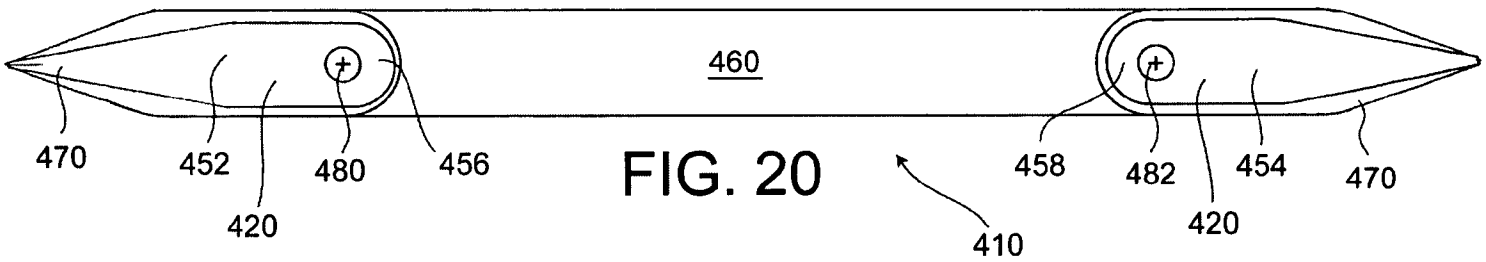
FIG. 20 is a top view of another embodiment of a grooving attachment.
Figure 21:
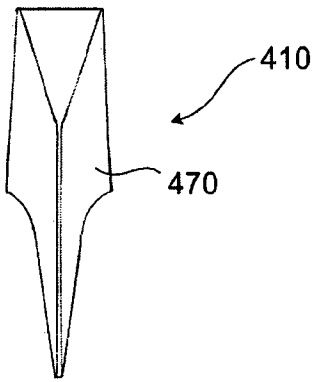
FIG. 21 is an end view of the embodiment of FIG. 20.
Figure 22:
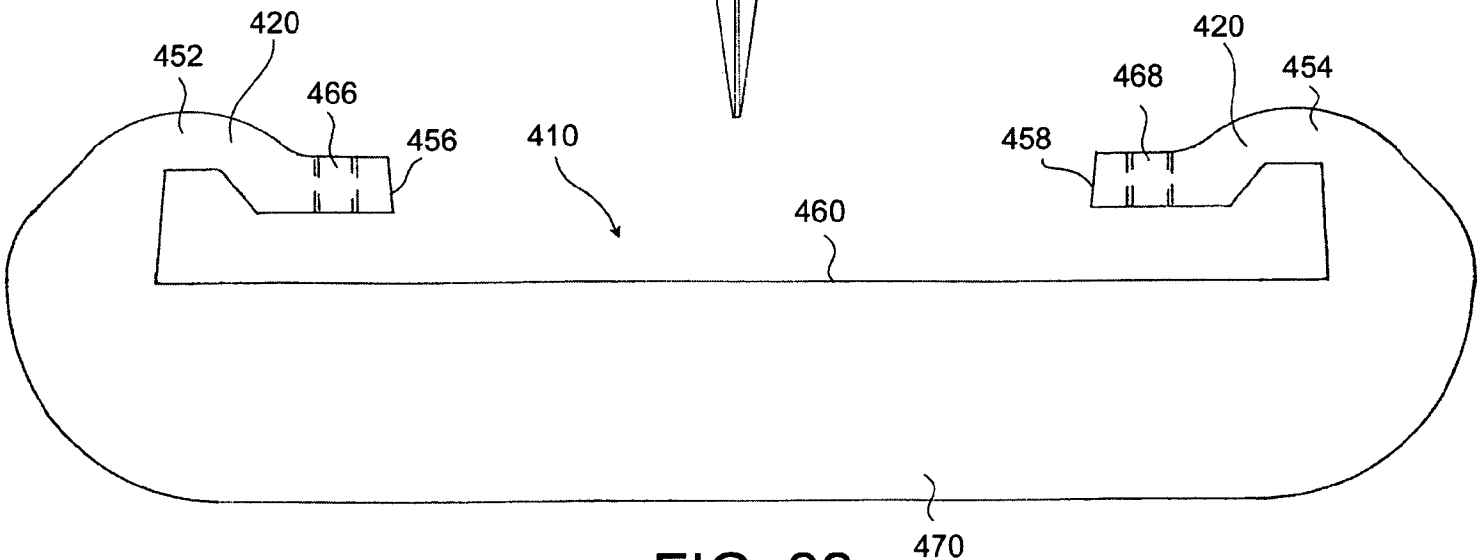
FIG. 22 is a side view of the embodiment of FIG. 20.

FIGS. 20-22 show another embodiment of a unitary stainless steel grooving attachment. The grooving attachment 410 in this embodiment includes a bit 470 and an attachment mechanism 420 for attaching to the body of a concrete-finishing tool, such as a bull float. As in FIGS. 16-19, the attachment mechanism 420 may include attachment supports (452, 454) with cantilevered portions (456, 458) and apertures (466, 468), for affixing to the body of the concrete-finishing tool. The grooving attachment 410 may be affixed by the screws 480 and 482 to the bull float or other tool through apertures 466 and 468, or by another fastening means.

Figure 23:
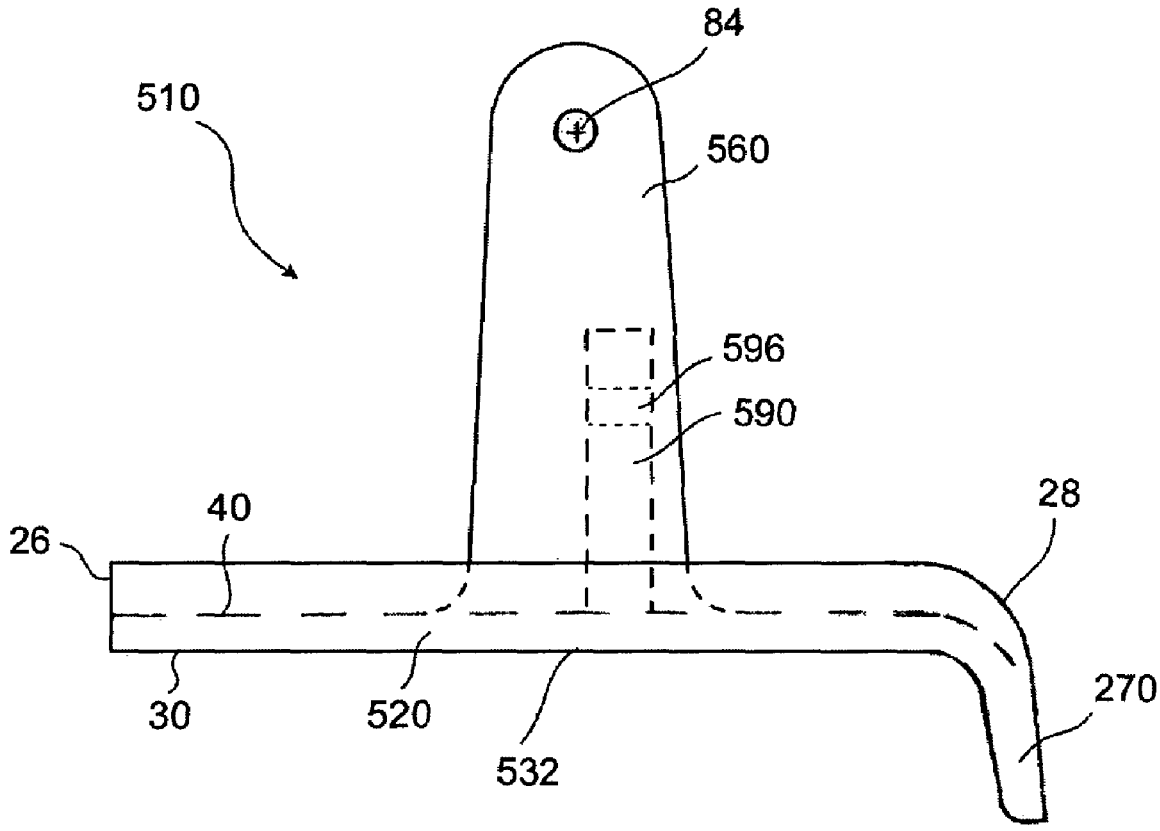
FIG. 23 is a rear view of an embodiment of an edger.
Figure 24:
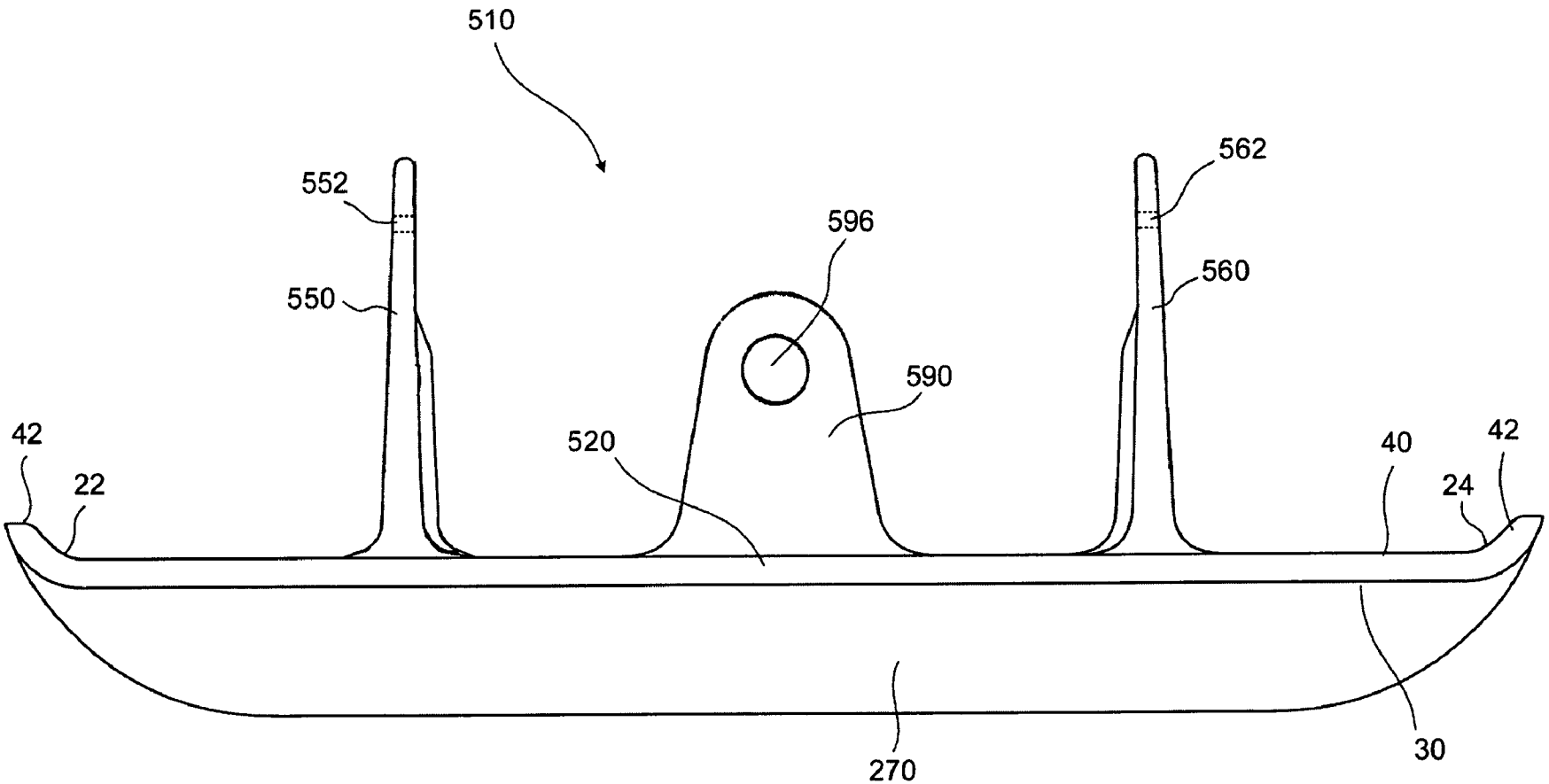
FIG. 24 is a side view of the embodiment of FIG. 23.
Figure 25:
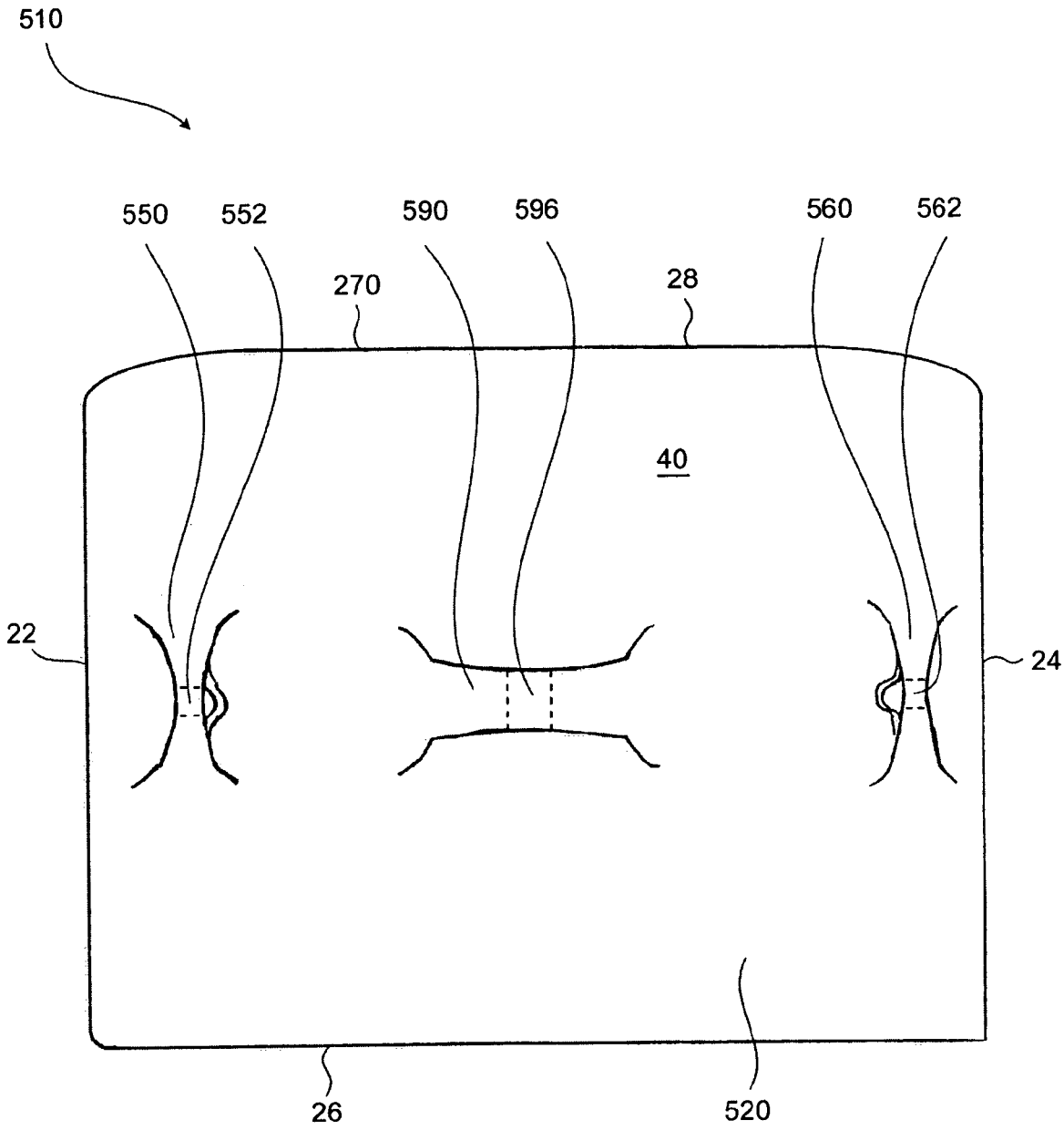
FIG. 25 is a top view of the embodiment of FIG. 23.

In another embodiment as shown in FIGS. 23-25, a concrete-finishing tool, an edger 510, includes a unitary stainless steel body 520 that includes a concrete-shaping element, here a lip 270 for edging, and a handle support, here the brackets 550 and 560 and/or the bracket 590. The lip 270 may be formed on the bottom face 30 of the body 520. The brackets 550 and 560 and/or the bracket 590 may be formed on the top face 40 of the body 520.

The body 520 may include a front edge 22 and a back edge 24, a first side 26 and a second side 28, and a bottom face 30 and a top face 40. Body 520 may further include a guiding portion 532 disposed on the bottom face 30, for guiding the edger 510 along concrete during operation. The guiding portion 532 may be generally flat, or another shape if desired. The top face 40 may include a projecting portion 42 that extends along the front edge 22 and the back edge 24. The top face 40 and the bottom face 30 may be flat and parallel, or shaped differently.

The edging element, lip 270, may extend from the front edge 22 to the back edge 24 of the body 520, along the second side 28 of the body. Viewed from the perspective of FIG. 23, the lip 270 may be curved and project from the bottom face 30, as well as from the second side 28, at a desired angle or angles. The lip 270 may alternatively be shaped as a straight or flat element or otherwise as function dictates.

The handle support may be the combination of brackets 550 and 560 (with apertures 552 and 562), or the bracket 590 (with an aperture 596), and is formed on the top face 40 of the body 520. The brackets 550 and 560 or the bracket 590 may be configured like the brackets 50 and 60 or the bracket 90, respectively, as described in embodiments herein, for supporting a handle. Alternatively, the brackets 550, 560 and 590 may all be included as part of the unitary stainless steel body of the edger 510. Alternatively, the unitary body 520 may include two brackets and a handle extending between the two brackets, such as described with respect to FIGS. 7-8.

Figure 26:
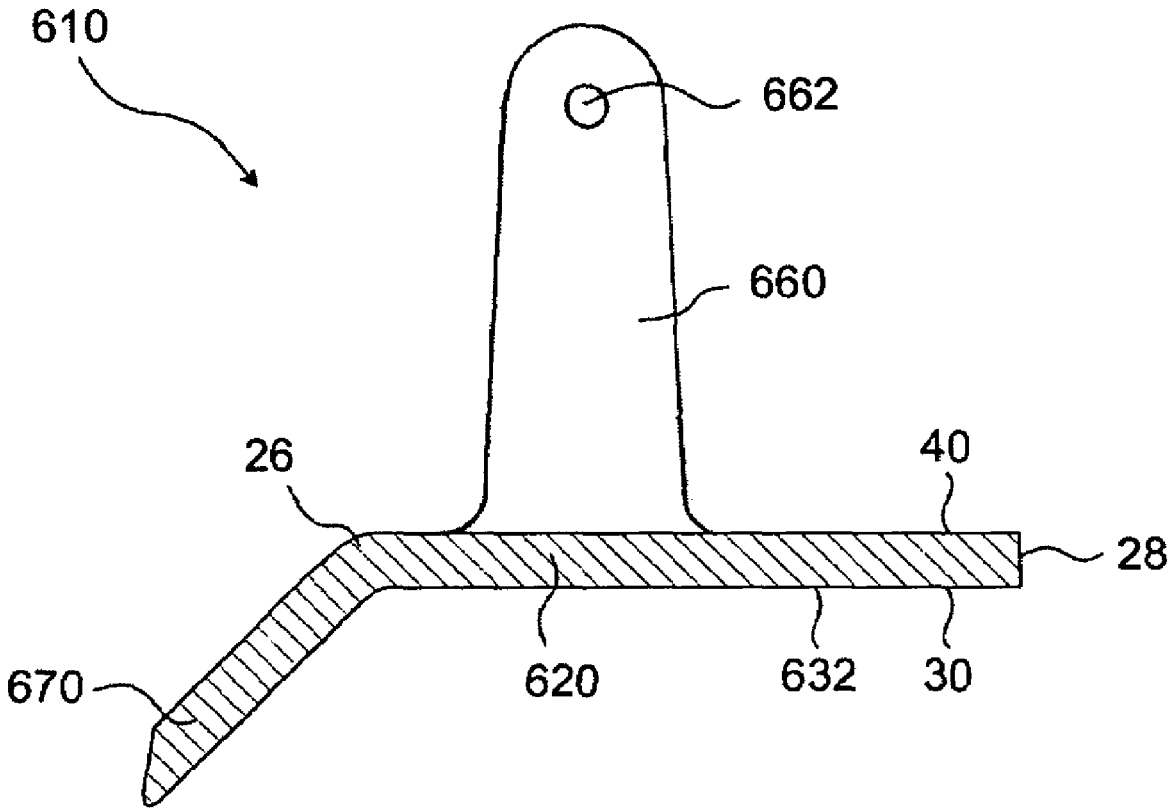
FIG. 26 is a cross-sectional view of another embodiment of an edger, at line X-X of FIG. 27.
Figure 27:
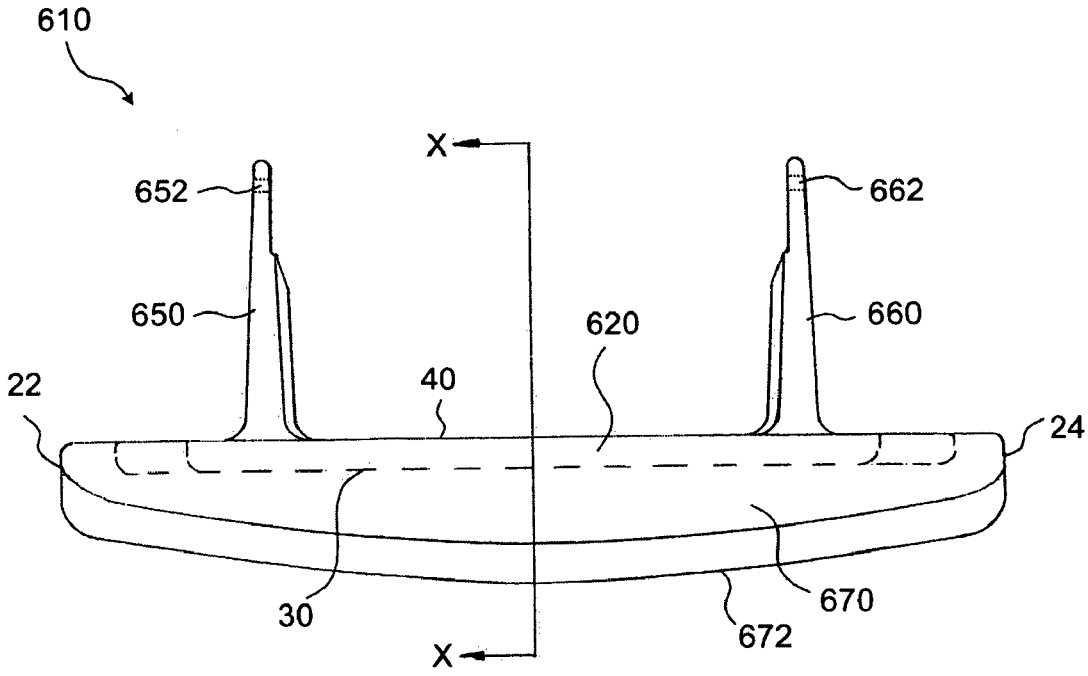
FIG. 27 is a side view of the embodiment of FIG. 26.
Figure 28:
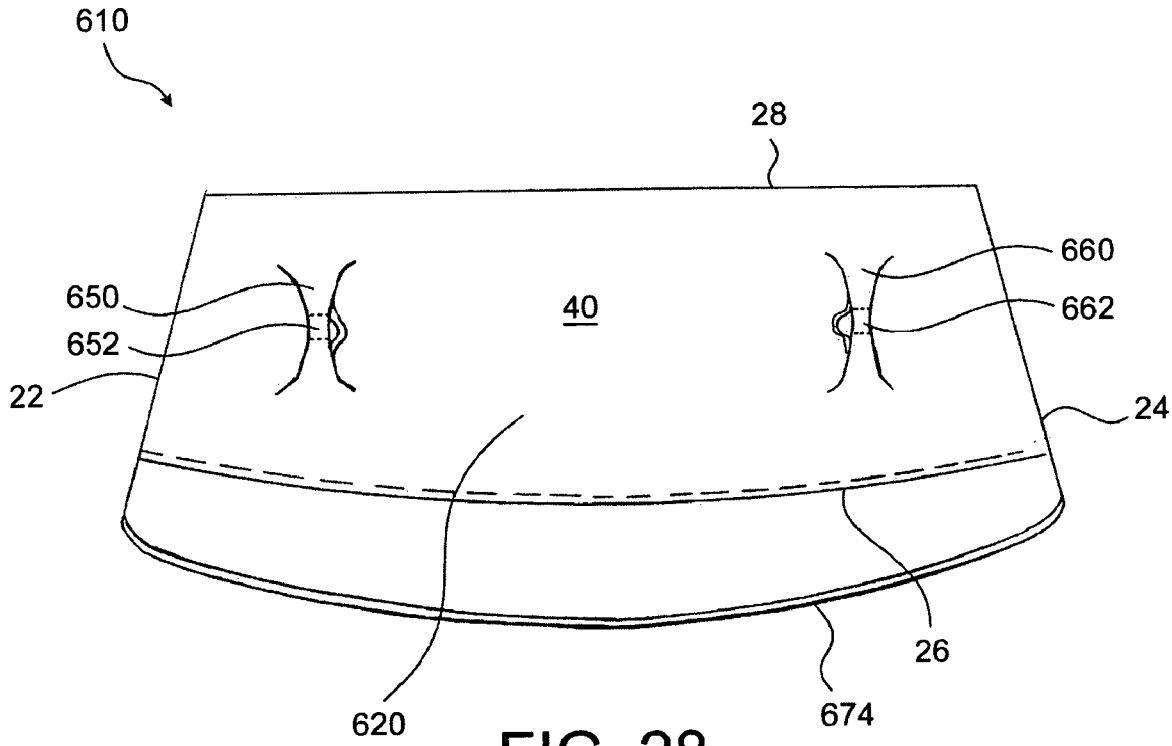
FIG. 28 is a top view of the embodiment of FIG. 26.

Another embodiment of an edger, the edger 610 as shown in FIGS. 26-28, provides another shape for an edging lip. Here, the lip 670 of the body 620 may be formed adjacent the guiding portion 632. The lip 670 may project from the bottom face 30, as well as projecting from the second side 28. The lip 670 may be curved at both its bottom surface 672, as shown from the perspective of FIG. 27, and at its outer surface 674, as shown from the perspective of FIG. 28. This lip configuration may be used to round an edge of a concrete slab. As in other embodiments, this edger 610 may include various handle support configurations, such as brackets 650 and 660 (and their apertures 652, 662), for supporting various handles, or another configuration described above or known in the art.

In another embodiment, any of the unitary bodies in the concrete-finishing tool embodiments may exclude a handle support. Thus, the unitary body may include a concrete-shaping element on its bottom face, and a mechanism for attaching a handle support on its top face. For example, with respect to the embodiment of the groover 10 in FIGS. 1-4, the stainless steel body 20 may be cast or forged such that it includes the bit 70 projecting from its bottom face 30, and apertures formed into, or below, the surface of the bottom face 40. The apertures may be formed, for example, as apertures 47 and 48 of the bracket support 46 of the groover 14 in FIGS. 12-14. A handle support, such as one described herein, may be fastened by screws or another method. Such a body configuration may also be substituted in the embodiments of the other concrete-finishing tools.

Constructing the bodies of the concrete-finishing tools or the attachments with stainless steel ("stainless steel" refers herein to various known or future developed stainless steel alloys) provides many advantageous properties in comparison to constructions with other metals, such as brass and zinc alloys, and malleable iron. These properties are due, in part, to the high chromium content of stainless steel, which contributes to its high hardness, and its wear and corrosion resistance.

The corrosion-resistant properties of stainless steel include the ability of stainless steel to inherently form a protective film of chromium-rich oxide at its surfaces. If the surface film is penetrated or worn away due to chipping, scratching, or other surface-damage, the newly-exposed surface may spontaneously regenerate a surface film in the presence of the oxygen in air. This property provides an advantage in stainless steel over a different metal body that is plated with corrosion-resistant material, since when the plating wears off from use, that other metal body's corrosion resistance may significantly decrease, and its surface hardness may suffer with use. The surface hardness of stainless steel, however, typically remains high even after prolonged use.

The material of the body or attachment in any of the above embodiments may be a stainless steel grade in the 400 series. Series 400 grades are martensitic stainless steels and have high hardness, impact strength and corrosion resistance. They may also be heat treated to increase their hardness. One series 400 stainless steel that may be used is grade 431, which has the best corrosion resistant properties of the martensitic steels.

Alternatively, where even higher corrosion resistance is desired, a 300 series austenitic stainless steel may be used for the body or attachment. One grade that may be used is 304L stainless steel, which has excellent corrosion resistance properties.

The unitary bodies or attachments may be manufactured to have desired properties. One such manufacturing method may be casting. Casting the body may provide better dimensional repeatability as compared with other production forms, such as forming the body with sheet metal. The method of casting used to produce the concrete-finishing tool body may be investment casting (also known as the "lost wax" method of casting), which provides excellent dimensional repeatability. Other methods may also be used, such as die-casting or sand casting.

A unitary stainless steel body or attachment manufactured by investment casting may be more than fifty percent harder and two-hundred percent stronger than current bodies and attachments cast from zinc and brass alloys, and malleable iron.

In another embodiment, the unitary stainless steel body or attachment may be formed by forging. Forging provides a body with high directional strength, structural integrity, and toughness. One method of forging may be the conventional closed die method. One form of stainless steel used in the forging process may be powdered stainless steel. Powdered stainless steel may be pressed into shape at a high pressure, sintered, and then forged. Other forms of stainless steel may also be used for forging a body or attachment.

Manufacturing the body or attachment by casting or forging may also provide more durability over other methods. For example, casting or forging may produce a body or attachment that is thicker and thus more wear resistant and longer lasting than a body formed with sheet metal. Additionally, a tool or attachment with a cast or forged body may be heavier and thus more sturdy and comfortable to a user, as compared with a body or attachment formed of sheet metal.

Once the unitary stainless steel body or attachment has been formed, it may be polished to a mirror-finish. Methods which may be applied include using a buffing wheel and a belt with a polishing compound. Polishing will provide a smooth tool working surface that minimizes drag when the surface slides against concrete during operation.

The foregoing description has been directed to specific embodiments of this invention. It will be apparent, however, that other variations and modifications may be made to the described embodiments, with the attainment of some or all of their advantages. For example, where the unitary stainless steel body in one of the above embodiments includes two brackets extending between a handle, the brackets and handle may be formed as a continuously rounded piece, or "C" shape, or another configuration.

It will also be appreciated that features described with respect to one embodiment may be applied to another, whether explicitly indicated. Therefore, it is the object of the appended claims to cover all such variations and modifications as come within the true spirit and scope of the invention.

What is claimed is:

1. A concrete-finishing tool comprising:

a unitary non-sheet metal stainless steel body having a top face and a bottom face and further comprising:

a handle support projecting from the top face; and a concrete-shaping element projecting from the bottom face, wherein the unitary non-sheet metal stainless steel body further comprises a front edge and a back edge, and wherein the concrete-shaping element has a substantially triangular cross-section and extends past at least one of the front edge and back edge.

2. A concrete-finishing tool comprising:

a unitary non-sheet metal stainless steel body having a top face and a bottom face and further comprising:

a handle support projecting from the top face; and a concrete-shaping element projecting from the bottom face, wherein the unitary non-sheet metal stainless steel body further comprises a front edge and a back edge and a side, and wherein the concrete-shaping element extends from the front edge to the back edge along the side.

* * * * *